US007823397B2

(12) United States Patent
Chang et al.

(10) Patent No.: US 7,823,397 B2
(45) Date of Patent: Nov. 2, 2010

(54) SYSTEM AND METHOD FOR DETECTING CLOGGED STATE OF PIPE OF HEAT PUMP TYPE MULTI-AIR CONDITIONER

(75) Inventors: Se-Dong Chang, Gyeonggi-Do (KR); Sung-Hwan Kim, Seoul (KR); Yoon-Been Lee, Seoul (KR); Baik-Young Chung, Incheon (KR)

(73) Assignee: LG Electronics Inc., Seoul (KR)

( * ) Notice: Subject to any disclaimer, the term of this patent is extended or adjusted under 35 U.S.C. 154(b) by 1407 days.

(21) Appl. No.: 11/258,275

(22) Filed: Oct. 26, 2005

(65) Prior Publication Data

US 2006/0086105 A1 Apr. 27, 2006

(30) Foreign Application Priority Data

Oct. 26, 2004 (KR) ..... 10-2004-0085919

(51) Int. Cl.

| | |
|---|---|
| ***G01K 13/00*** | (2006.01) |
| ***F25B 49/00*** | (2006.01) |
| ***F25B 41/00*** | (2006.01) |
| ***F25B 13/00*** | (2006.01) |
| ***E03B 7/07*** | (2006.01) |

(52) U.S. Cl. ..... 62/129; 62/127; 62/203; 62/208; 62/324.6; 137/557; 137/559

(58) Field of Classification Search ..... 62/129, 62/127, 203, 208, 324.6; 137/557, 559
See application file for complete search history.

(56) References Cited

U.S. PATENT DOCUMENTS

| | | | | |
|---|---|---|---|---|
| 5,009,076 | A * | 4/1991 | Winslow | 62/129 |
| 5,490,399 | A * | 2/1996 | Sada | 62/510 |
| 5,941,084 | A * | 8/1999 | Sumida et al. | 62/129 |
| 6,041,611 | A | 3/2000 | Palmer | |
| 6,631,618 | B2 * | 10/2003 | Renders | 62/115 |
| 6,701,725 | B2 * | 3/2004 | Rossi et al. | 62/125 |

FOREIGN PATENT DOCUMENTS

| | | | |
|---|---|---|---|
| EP | 1 102 018 | A1 | 5/2001 |
| EP | 1 321 727 | A2 | 6/2003 |
| EP | 1 321 727 | A3 | 6/2003 |
| JP | 2001-133011 | A | 5/2001 |

* cited by examiner

*Primary Examiner*—Frantz F Jules
*Assistant Examiner*—Travis Ruby
(74) *Attorney, Agent, or Firm*—Birch, Stewart, Kolasch & Birch, LLP

(57) ABSTRACT

A method for detecting a clogged state of a pipe of a heat pump type multi-air conditioner includes: detecting a temperature of a pipe of an arbitrary indoor heat exchanger among a plurality of indoor heat exchangers; detecting a pressure of a refrigerant sucked into an arbitrary outdoor unit among a plurality of outdoor units in case of performing an air-conditioning operation, and detecting a pressure of a refrigerant introduced into the arbitrary indoor heat exchanger after being discharged from an arbitrary outdoor unit among the plurality of outdoor units in case of performing a heating operation; and comparing a pressure corresponding to the detected temperature of the pipe and the detected pressure of the refrigerant and determining whether the pipe is clogged based on the comparison result. By detecting a clogged state of a pipe, the heat pump type multi-air conditioner is prevented from being damaged due to a clogged state of the pipe.

16 Claims, 10 Drawing Sheets

SYSTEM AND METHOD FOR DETECTING CLOGGED STATE OF PIPE OF HEAT PUMP TYPE MULTI-AIR CONDITIONER

BACKGROUND OF THE INVENTION

1. Field of the Invention

The present invention relates to a heat pump type air-conditioner and, more particularly, to a system and method for detecting a clogged state of a pipe of the heat pump type multi-air conditioner capable of detecting a clogged state of a pipe of a heat pump type multi-air conditioner including a plurality of outdoor units and a plurality of indoor units.

2. Description of the Background Art

An air-conditioner is a device for controlling a temperature, humidity, an airflow and cleanliness of a room to make an agreeable indoor environment. According to the construction of included elements, the air-conditioner is divided into an integrated type air-conditioner of which an indoor unit and an outdoor unit are all accommodated in a single case and a separated type air-conditioner of which a compressor and a condenser are used as an outdoor unit and an evaporator is used as an indoor unit, separately.

Also, there is an air-conditioning/heating combined air-conditioner which can selectively perform a cooling and heating operation by switching a fluid path of a refrigerant by using a four-way valve, and recently, a multi-air conditioner having a plurality of indoor units which can perform cooling or heating in each indoor space is increasingly used. As for the multi-air conditioner, in order to suitably cope with an operation load of the plurality of indoor units, a plurality of outdoor units each having a compressor are used to be connected in parallel with the plurality of indoor units.

A structure and operation of a heat pump type multi-air conditioner including a plurality of outdoor units and a plurality of indoor units in accordance with a background art will now be described with reference to FIG. 1.

FIG. 1 illustrates the construction of an outdoor unit of a heat pump type multi-air conditioner in accordance with a background art.

As shown in FIG. 1, a plurality of outdoor units 11*a*~11*n* include a pair of first and second compressors 13*a* and 13*b* for compressing a refrigerant; a four-way valve 21 for switching a flow path of the refrigerant; an outdoor heat exchanger 23 for exchanging heat absorbed by the refrigerant with outdoor air; and a common accumulator 25 for providing a gaseous refrigerant to the first and second compressors 13*a* and 13*b*, respectively.

A discharge pipe 15 for discharging the refrigerant is provided at an upper portion of the first and second compressors 13*a* and 13*b*, respectively, and a suction pipe 17 connected with the accumulator 25 is coupled with a lower portion of each compressor and supplies the refrigerant to the compressors.

An oil-balancing pipe 19 is connected between the first and second compressors 13*a* and 13*b* so that oil inside the compressors 13*a* and 13*b* can flow to each other.

An oil separator 31 and a check valve 33 are provided at each discharge side of the first and second compressors 13*a* and 13*b*, and an oil return flow path 35 for returning oil to the suction side of each compressor is connected with the oil separator 31.

The four-way valve 21 for switching the flow path of the refrigerant is provided at a lower side of the check valve 33.

One port of the four-way valve 21 is connected with the outdoor heat exchanger 23, another port of the four-way valve 21 is connected with the common accumulator 25, and still another port of the four-way valve 21 is connected with one end of a connection pipe 41 connected with the side of an indoor unit.

A receiver 37 is provided at one side of the outdoor heat exchanger 23 according to a direction of a flow of the refrigerant, and service valves 43*a* and 43*b* are provided at one side of the receiver 37 and one side of the connection pipe 41.

The service valves 43*a* and 43*b* are connected with main refrigerant pipes 45 which connects the outdoor units 11*a*~11*n*.

As shown in FIG. 2, the background art heat pump type multi-air conditioner connects the plurality of outdoor units 11*a*~11*n* and the plurality of indoor units.

FIG. 2 illustrates a state of connection between the plurality of outdoor units and the plurality of indoor units.

The plurality of outdoor units 11*a*~11*n* and the plurality of indoor units are connected through a communication line, and one of the plurality of outdoor units 11*a*~11*n* is operated as a central controller controls cooling/heating air-conditioning of the other remaining outdoor units and the plurality of indoor units.

However, the background art heat pump type multi-air conditioner has the following problems.

That is, since the plurality of outdoor units and the plurality of indoor units are to be connected to be used, a diameter of the pipe is increased, and due to an installation condition that the pipe is lengthened, more parts of the pipe are to be welded, increasing a probability that debris exists inside the pipe as shown in FIG. 3. In this case, if debris is collected on a strainer inside the pipe, it would clog the pipe, preventing a normal operation of the multi-air conditioner to degrade an air-conditioning force or heating force.

BRIEF DESCRIPTION OF THE INVENTION

Therefore, one object of the present invention is to provide a system and method for detecting a clogged state of a pipe of a heat pump type multi-air conditioner having a plurality of outdoor units and a plurality of indoor units Capable of preventing a damage of the heat pump type multi-air conditioner due to clogging phenomenon of a pipe by setting information of a kind of a refrigerant and a refrigerant circulation cycle when an air-conditioning operation or a heating operation is normally performed as reference data, comparing information of a refrigerant circulation cycle generated when an air-conditioning operation or a heating operation is performed with the reference data, and detecting a clogging state of the pipe based on the comparison result.

Another object of the present invention is to provide a system and method for detecting a clogged state of a pipe of a heat pump type multi-air conditioner having a plurality of outdoor units and a plurality of indoor units, capable of detecting a clogged state of a pipe based on a difference between a pressure corresponding to a temperature of a pipe of an indoor heat exchanger in case of an air-conditioning operation and a pressure of a refrigerant in a low pressure state measured by an arbitrary outdoor unit.

Still another object of the present invention is to provide a system and method for detecting a clogged state of a pipe of a heat pump type multi-air conditioner having a plurality of outdoor units and a plurality of indoor units, capable of detecting a clogged state of a pipe based on a difference between a pressure corresponding to a temperature of a pipe of an indoor heat exchanger in case of a heating operation and a pressure of a refrigerant in a high pressure state measured by an arbitrary outdoor unit.

To achieve these and other advantages and in accordance with the purpose of the present invention, as embodied and broadly described herein, there is provided a system for detecting a clogged state of a pipe of a heat pump type multi-air conditioner, including: a plurality of first pressure detection sensors for detecting a pressure of a refrigerant sucked into a plurality of outdoor units; a plurality of second pressure detection sensors for detecting a pressure of a refrigerant discharged from the plurality of outdoor units; a plurality of pipe temperature detection units for detecting a temperature of each pipe of a plurality of indoor heat exchangers; a storage unit for storing first pressure data corresponding to each temperature of each pipe of each indoor heat exchanger detected by the plurality of pipe temperature detection units in case of performing an air-conditioning operation and second pressure data corresponding to each temperature of each pipe of each indoor heat exchanger detected by the plurality of pipe temperature detection units in case of performing a heating operation; and a microcomputer for comparing low pressure data detected by an arbitrary first pressure detection sensor among the plurality of first pressure detection sensors with the first pressure data and checking whether a pipe is clogged based on the comparison result in case of performing the air-conditioning operation, and comparing low pressure data detected by an arbitrary second pressure detection sensor among the plurality of first pressure detection sensors with the second pressure data and determining whether a pipe is clogged based on the comparison result in case of performing the heating operation.

To achieve the above objects, there is also provided a system for detecting a clogged state of a pipe of a heat pump type multi-air conditioner, including: a storage unit for storing data of a first curved line pattern based on a refrigerant circulation cycle in case of a normal operation; a plurality of indoor temperature sensors for detecting indoor temperatures of an area where a plurality of indoor units are positioned; a plurality of outdoor temperature sensors for detecting outdoor temperatures of an area where a plurality of outdoor units are positioned; and a microcomputer for selecting an arbitrary indoor unit among the plurality of indoor units and an arbitrary outdoor unit among the plurality of outdoor units, generating a second curved line pattern based on an indoor temperature detected by an indoor temperature sensor of the arbitrary indoor unit, an outdoor temperature detected by an outdoor temperature sensor of the arbitrary outdoor unit, and an operation capacity of a compressor of the arbitrary outdoor unit, comparing the second curved line pattern with the first curved line pattern, and determining whether a pipe of the arbitrary outdoor unit is clogged based on the comparison result.

To achieve the above objects, there is also provided a method for detecting a clogged state of a pipe of a heat pump type multi-air conditioner, including: detecting a temperature of a pipe of an arbitrary indoor heat exchanger among a plurality of indoor heat exchangers; detecting a pressure of a refrigerant sucked into an arbitrary outdoor unit among a plurality of outdoor units in case of performing an air-conditioning operation, and detecting a pressure of a refrigerant introduced into the arbitrary indoor heat exchanger after being discharged from an arbitrary outdoor unit among the plurality of outdoor units in case of performing a heating operation; and comparing a pressure corresponding to the detected temperature of the pipe and the detected pressure of the refrigerant and determining whether the pipe is clogged based on the comparison result.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

A system and method for detecting a clogged state of a pipe of a heat pump type multi-air conditioner capable of preventing a damage of the heat pump type multi-air conditioner due to a clogged state of a pipe by checking the pipe (namely, a strainer) based on information of a kind of a refrigerant and a refrigerant circulation cycle when the heat pump type multi-air conditioner is normally operated and information of a refrigerant circulation cycle generated when an air-conditioning operation or a heating operation is performed, in accordance with the present invention will now be described with reference to FIGS. 4 to 13.

Figure 1:
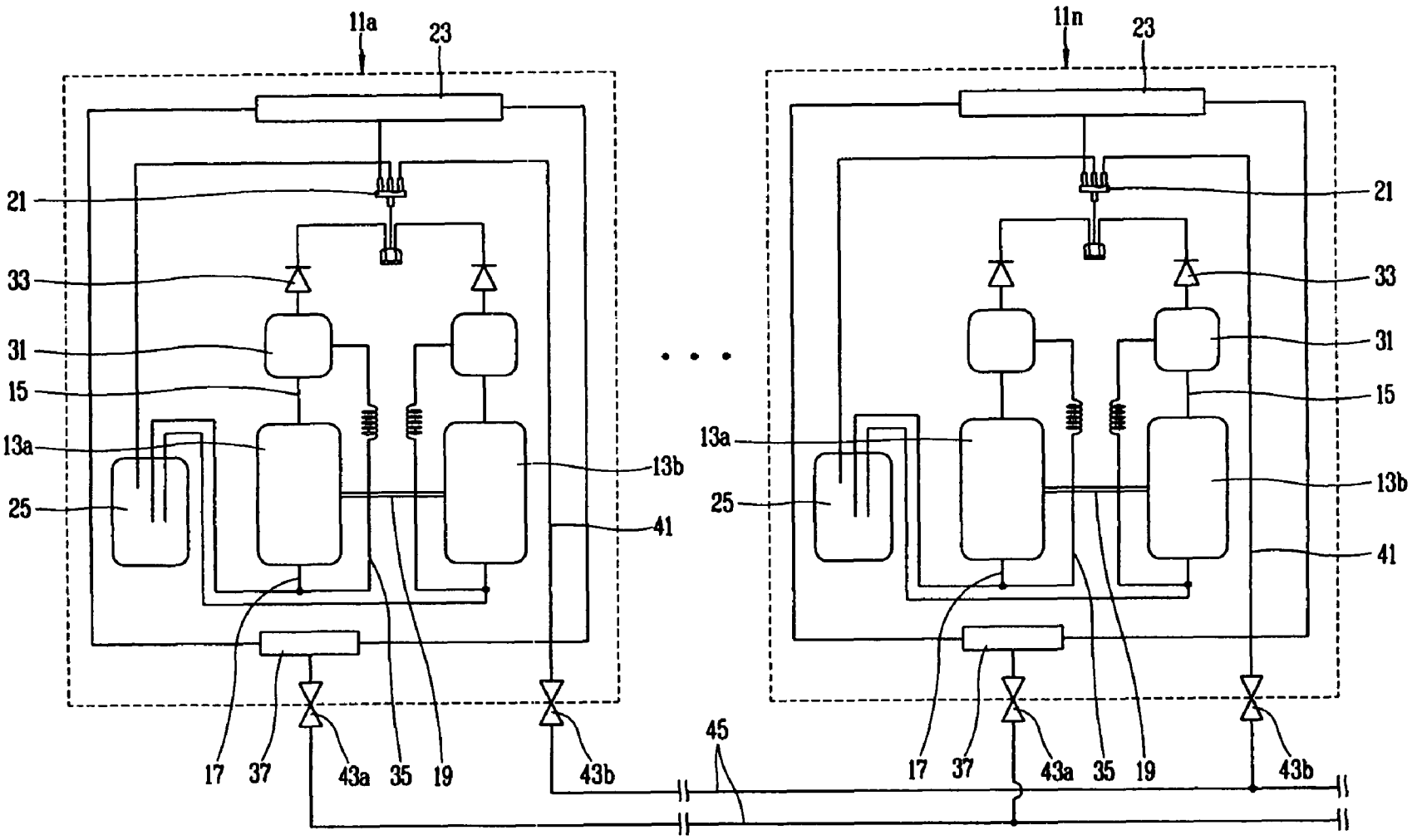
FIG. 1 BACKGROUND ART
FIG. 1 illustrates the construction of an outdoor unit of a heat pump type multi-air conditioner in accordance with a background art.
Figure 2:
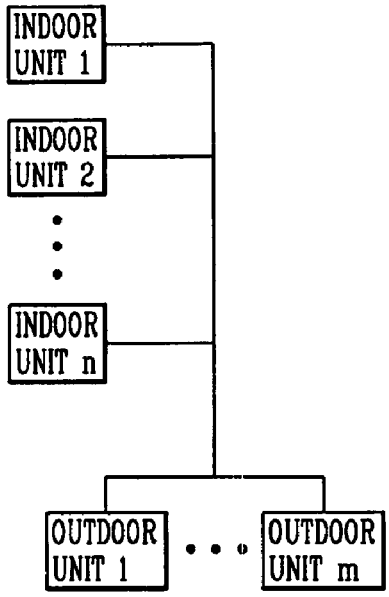
FIG. 2 BACKGROUND ART
FIG. 2 illustrates a state of connection between the plurality of outdoor units and the plurality of indoor units in FIG. 1.
Figure 3:
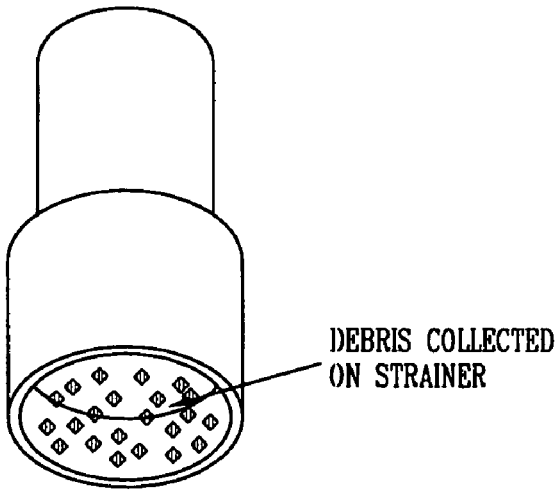
FIG. 3 BACKGROUND ART
FIG. 3 illustrates debris collected on a strainer of a pipe of an outdoor unit in FIG. 2.
Figure 4:
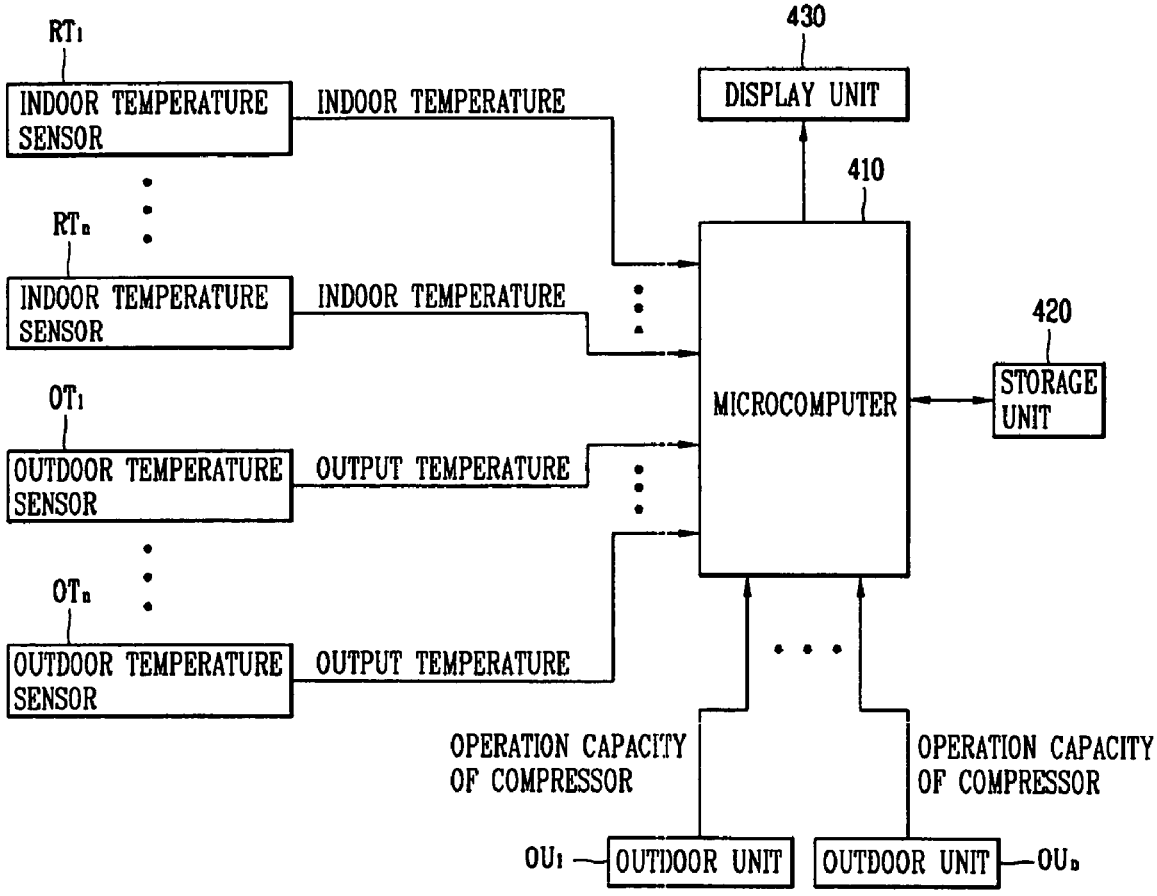
FIG. 4 is a schematic block diagram showing the construction of a system for detecting a clogged state of a heat pump type multi-air conditioner in accordance with a first embodiment of the present invention.

FIG. 4 is a schematic block diagram showing the construction of a system for detecting a clogged state of a heat pump type multi-air conditioner in accordance with a first embodiment of the present invention.

As shown in FIG. 4, a system for detecting a clogged state of a pipe of a heat pump type multi-air conditioner includes: a storage unit 420 for storing data of a reference curved line pattern according to each state of a refrigerant of a refrigerant circulation cycle, namely, a reference for determining an operation state of the heat pump type multi-air conditioner; a plurality of indoor temperature sensors RT1~RTn for detecting an indoor temperature of each area where a plurality of indoor units IU1~IUn are positioned, respectively; a plurality of outdoor temperature sensors OT1~OTn for detecting an outdoor temperature of each area where a plurality of outdoor units OU1~OUn are positioned, respectively; a microcomputer 410 for receiving the detected outdoor temperatures and the detected indoor temperatures, generating a curved line pattern based on an outdoor temperature of an area where an arbitrary outdoor unit, among the plurality of outdoor units OU1~OUn, a compressor capacity of the arbitrary indoor unit, and an indoor temperature of an area where an arbitrary indoor unit is positioned, among the plurality of indoor units IU1~IUn, comparing the generated curved line pattern with the reference curved line pattern, and determining whether a pipe (namely, a strainer) of the arbitrary outdoor unit is clogged based on the comparison result; and a display unit 430 for displaying whether the pipe of the arbitrary outdoor unit is clogged according to a command of the microcomputer 410.

The reference curved line pattern is made by converting a curved line pattern according to a high pressure (Ph) and a low pressure (PI) at the side of a main outdoor unit and an operation frequency of a compressor of the main outdoor unit when the heat pump type multi-air conditioner is normally operated, into a curved line pattern according to three factors of an indoor temperature, an outdoor temperature and capacity of an indoor unit. Herein, the capacity of an indoor unit can be indicated as an operation capacity of a compressor of an outdoor unit, and the reference curved line pattern can be used as a basis for determining whether or not the air conditioner is properly installed or a degree of improper installation of the air conditioner.

The microcomputer 410 compares the generated curved line pattern and the reference curved line pattern. If a difference value between the generated curved line pattern and the reference curved line pattern is greater than a predetermined range value (C), the microcomputer 410 recognizes that the pipe is clogged, while if the difference value is not greater than the predetermined range value (C), the microcomputer 410 recognizes that the pipe is not clogged.

The method for detecting a clogged state of the pipe of the heat pump-type multi-air conditioner constructed as shown in FIG. 4 will be described with reference to FIGS. 5, 6A and 6B.

Figure 5:
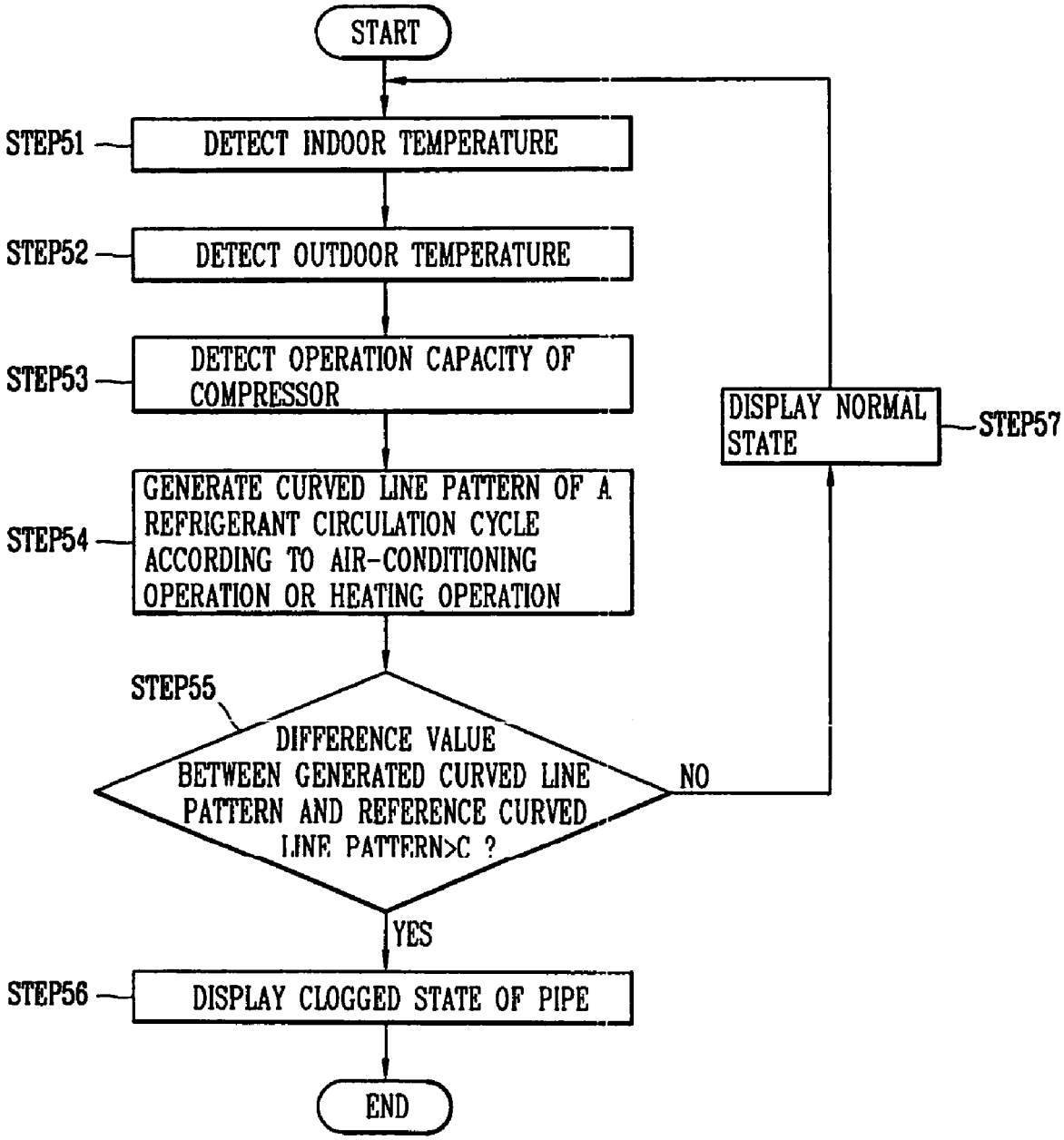
FIG. 5 is a flow chart illustrating the processes of a method for detecting a clogged state of a pipe of the heat pump type multi-air conditioner in accordance with a first embodiment of the present invention.
Figure 6A:
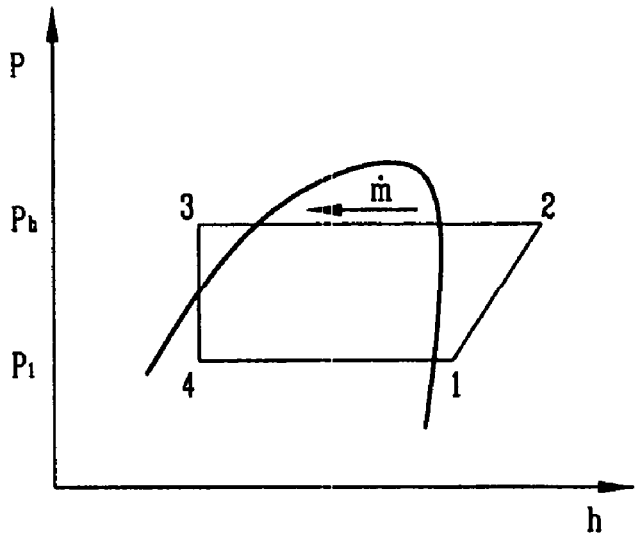
FIGS. 6A and 6B are graphs showing a P-H diagram and a T-S diagram in case of a normal operation in FIG. 4.
Figure 6B:
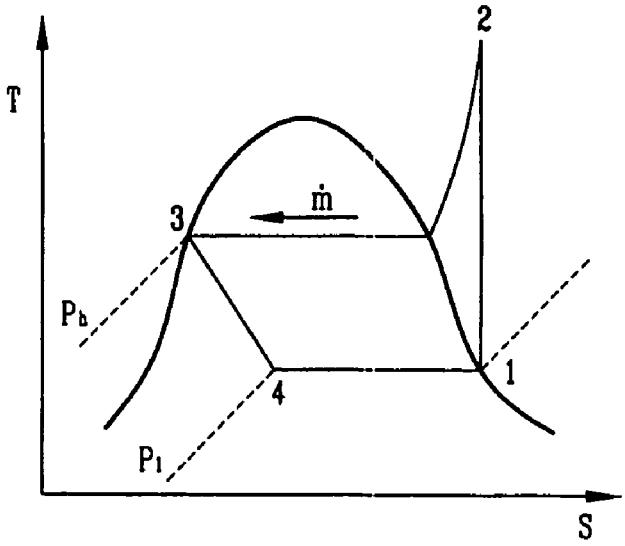

FIG. 5 is a flow chart illustrating the processes of a method for detecting a clogged state of a pipe of the heat pump type multi-air conditioner in accordance with a first embodiment of the present invention. FIG. 6A is a graph showing a curved line pattern according to three factors of a high pressure (Ph), a low pressure (PI) and an operation frequency of a compressor in a refrigerant circulation cycle in case of a normal operation, and as shown in FIG. 6B, the curved line pattern according to the three factors is converted into a reference curved line pattern according to an indoor temperature, an outdoor temperature and capacity of an indoor unit and discriminately stored in the storage unit 420 according to an air-conditioning operation mode and a heating operation mode.

First, the microcomputer 410 arbitrarily selects one of the plurality of indoor units IU1~IUn and detects an indoor temperature of an area where the selected indoor unit is positioned through an indoor temperature sensor installed in the selected indoor unit (STEP51).

Next, the microcomputer 410 arbitrarily selects one of outdoor units OU1~OUn and detects an outdoor temperature of an area where the selected outdoor unit is positioned through an outdoor temperature sensor installed in the selected outdoor unit (STEP52).

Thereafter, the microcomputer 410 receives an operation capacity of a compressor of an outdoor unit being currently operated (STEP53).

And then, the microcomputer 410 generates a curved line pattern according to a refrigerant circulation cycle based on the detected indoor temperature, the detected outdoor temperature and the operation capacity of the compressor (STEP54).

And the microcomputer 410 compares the generated curved line pattern with a reference curved line pattern of the air-conditioning operation mode or a reference curved line pattern of the heating operation mode previously stored in the storage unit 420, according to a current operation mode (STEP55).

Finally, if a difference between the generated curved line pattern and the reference curved line pattern is greater than the pre-set range value (C), the microcomputer 410 recognizes that the pipe is clogged and displays the recognition result on the display unit 430 to inform a user accordingly (STEP55 and STEP56).

If, however, the difference between the generated curved line pattern and the reference curved line pattern is not greater than the pre-set range value (C), the microcomputer 410 recognizes that the pipe is in a normal state and displays the recognition result on the display unit 430 to inform the user accordingly, and then, returns to the indoor temperature detecting STEP51 (STEP55 and STEP57).

Namely, according to the method for detecting a clogged state of the pipe of the heat pump type multi-air conditioner in accordance with the present invention, the reference curved line pattern of the three factors, namely, the indoor temperature, the outdoor temperature, and capacity of an indoor unit is generated by converting a curved line pattern according to a high pressure (Ph), a low pressure (PI) and an operation frequency of a compressor of a refrigerant circulation cycle of the normally operated heat pump type multi-air conditioner, and then, compared with a curve line pattern obtained based on three factors of an indoor temperature, an outdoor temperature and capacity of an indoor unit obtained by operating the heat pump type multi-air, thereby detecting whether the heat pump type multi-air conditioner is properly installed or not and a clogged state of the pipe of the air conditioner.

A system and method for detecting a clogged state of a pipe of the heat pump type multi-layer conditioner in accordance with a second embodiment of the present invention will now be described with reference to FIGS. 7 to 13.

Figure 7:
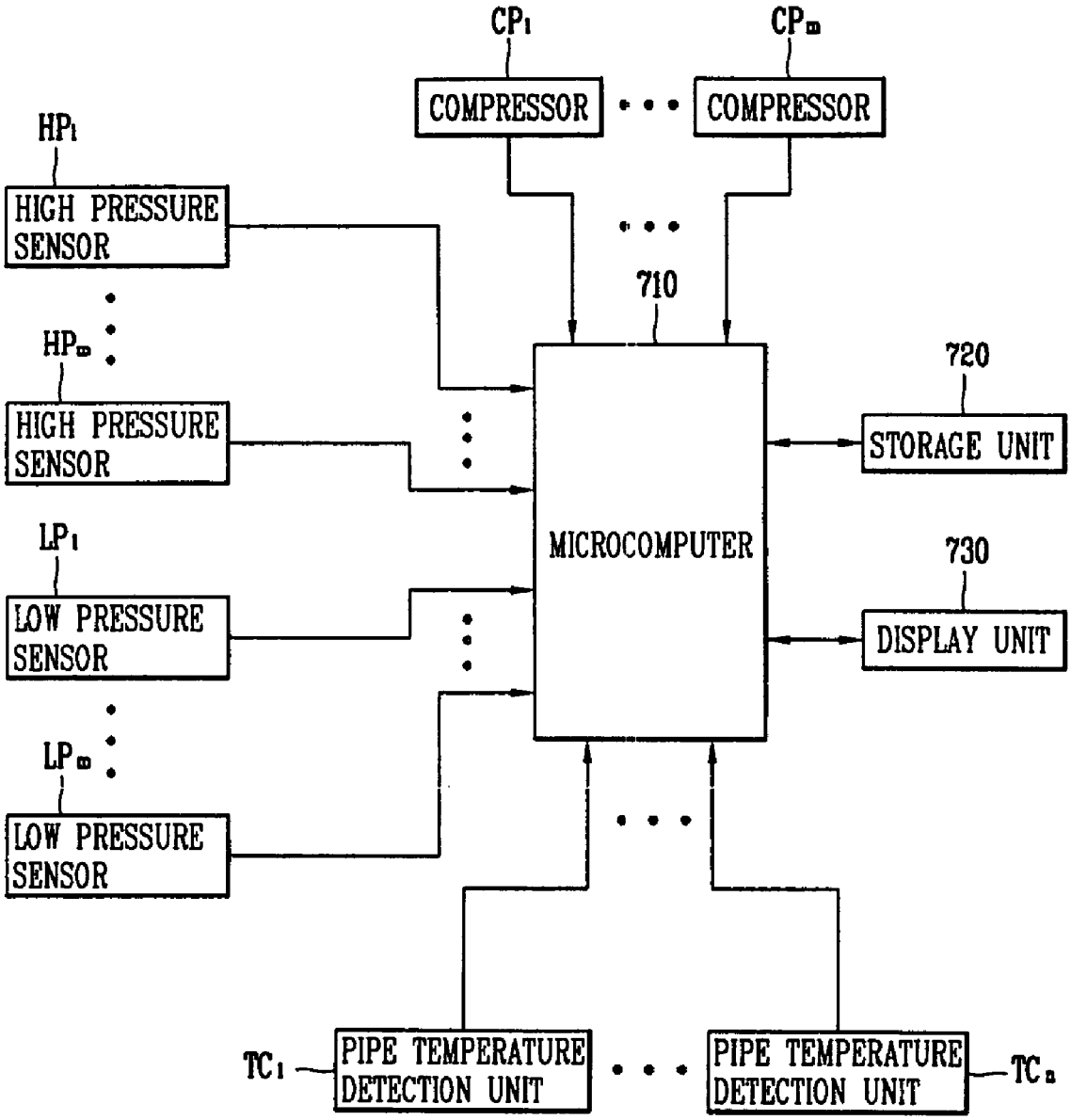
FIG. 7 is a schematic block diagram showing the construction of a system for detecting a clogged state of a heat pump type multi-air conditioner in accordance with a second embodiment of the present invention.

FIG. 7 is a schematic block diagram showing the construction of a system for detecting a clogged state of a heat pump type multi-air conditioner in accordance with a second embodiment of the present invention.

As shown in FIG. 7, the system for detecting a clogged state of a pipe of a multi-air conditioner in accordance with the present invention includes: a plurality of compressors CP1~CPm; a plurality of low pressure sensors LP1~LPm; a plurality of high pressure sensors HP1~HPm; a plurality of pipe temperature detection units TC1~TCm; a microcomputer 710; a storage unit 720; and a display unit 730.

Each element of the system will be described in detail as follows.

The plurality of compressors CP1~CPm are provided in each outdoor unit, and a compression capacity is varied according to an operation frequency command value.

The plurality of low pressure sensors LP1~LPm are provided in each outdoor unit and detect a pressure of a refrigerant in a low pressure state sucked into the plurality of compressors CP1~CPm.

The plurality of high pressure sensors HP1~HPm are provided in each outdoor unit and detect a pressure of a refrigerant in a high pressure state discharged from the plurality of compressors CP1~CPm.

The plurality of pipe temperature detection units TC1~TCn are provided in each indoor unit (not shown) and detect a pipe temperature (TC) of an indoor heat exchanger (not shown) provided in each of the plurality of indoor units when the multi-air conditioner operates in an air-conditioning mode or in a heating mode.

The storage unit 720 previously stores first pressure data corresponding to temperature of a pipe of each indoor heat exchanger detected by the plurality of pipe temperature detection units TC1~TCn according to a kind of a refrigerant when the multi-air conditioner operates in the air-conditioning mode, and second pressure data corresponding to a temperature of a pipe of each indoor heat exchanger detected by the plurality of pipe temperature detection units TC1~TCn according to the kind of the refrigerant when the multi-air conditioner operates in the heating mode.

When the multi-air conditioner performs the air-conditioning operation, the microcomputer 710 compares low pressure data outputted from an arbitrary pressure sensor among the plurality of low pressure sensors (LP1~LPm) and the first pressure data, displays whether the pipe is clogged on the display unit 730 based on the comparison result. When the multi-air conditioner performs the heating operation, the microcomputer 710 compares the high pressure data outputted from an arbitrary high pressure sensor among the plurality of high pressure sensors HP1~HPm, compares it with the second pressure data, and displays whether the pipe is clogged on the display unit 730 based on the comparison result.

Herein, if a difference value between the low pressure data outputted from the arbitrary lower pressure sensor and the first pressure data is greater than the pre-set first value (C1), the microcomputer 710 recognizes that a strainer of an outdoor unit having the arbitrary lower pressure sensor is clogged. If a difference value between the high pressure data outputted from the arbitrary high pressure sensor and the second pressure data is greater than the pre-set second value (C2), the microcomputer 710 recognizes that a strainer of an outdoor unit having the arbitrary high pressure sensor is clogged.

The display unit 730 displays whether the pipe is clogged or not according to a command of the microcomputer 710.

A method for detecting a clogged stage of a pipe of the system for detecting a clogged state of a pipe of the heat pump type multi-air conditioner in accordance with the second embodiment of the present invention both in case of the air-conditioning operation and in case of the heating operation will now be described in detail.

Figure 8:
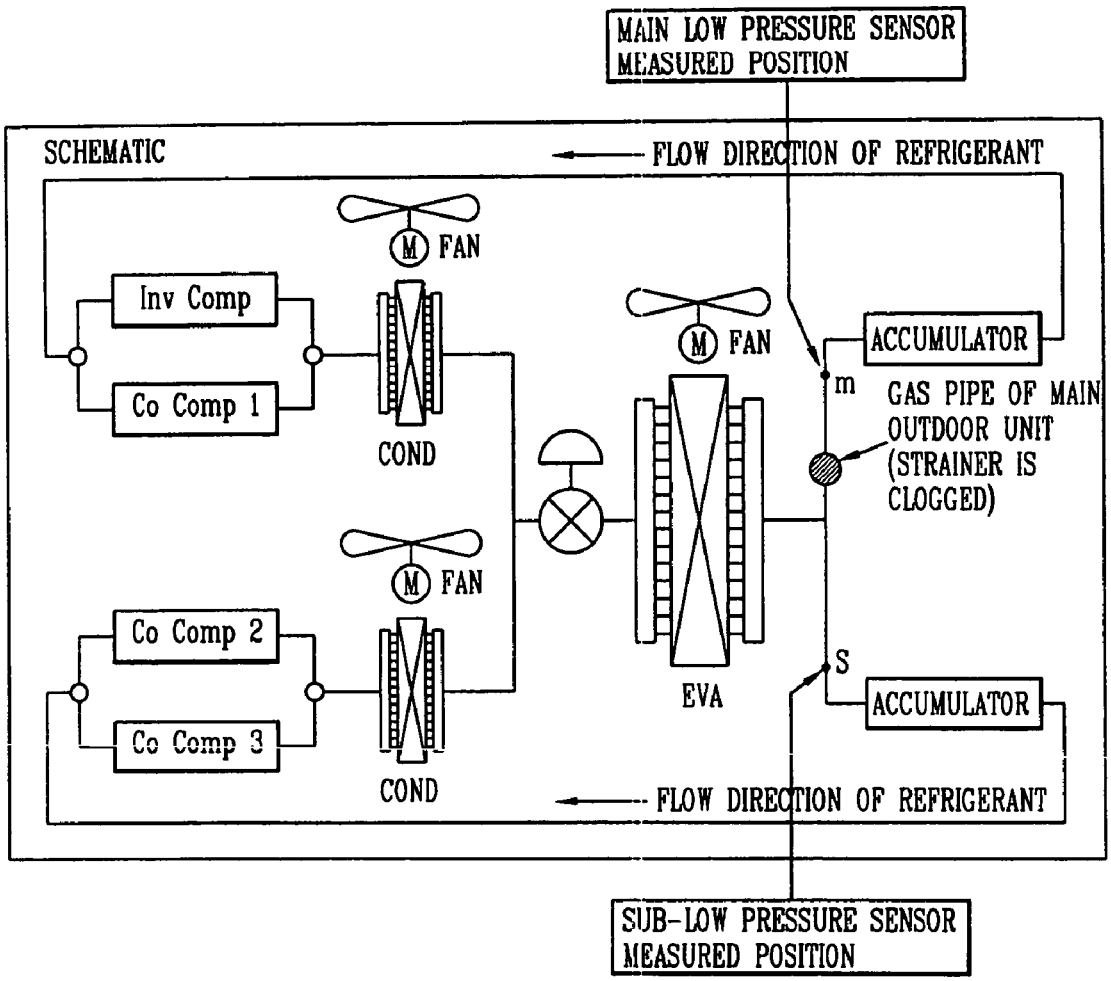
FIG. 8 is a schematic diagram of a refrigerant circulation cycle in case of performing an air-conditioning operation of the neat pump type multi-air conditioner including a main outdoor unit and a sub-outdoor unit each having two compressors in accordance with the second embodiment of the present invention.
Figure 9:
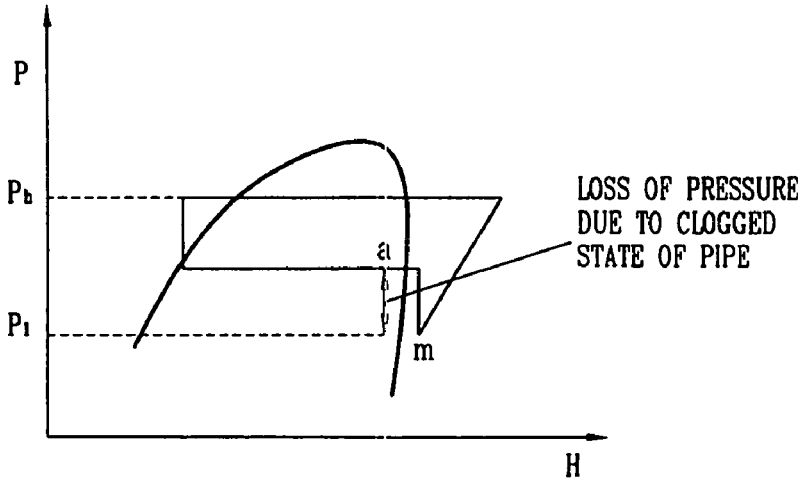
FIG. 9 is a graph showing a P-H diagram showing a state change occurring in the refrigerant circulation cycle when a pipe is clogged in case of performing the air-conditioning operation.

FIG. 8 is a schematic diagram of a refrigerant circulation cycle in case of performing an air-conditioning operation of the heat pump type multi-air conditioner including a main outdoor unit and a sub-outdoor unit each having two compressors in accordance with the second embodiment of the present invention, and FIG. 9 is a graph showing a P-H diagram showing a state change occurring in the refrigerant circulation cycle when a pipe is clogged in case of performing the air-conditioning operation.

As shown in FIG. 8, when a pipe connected from an evaporator (namely, an indoor heat exchanger) to the accumulator of a main outdoor unit is clogged as debris is collected on a strainer of the pipe, as shown in FIG. 9, a pressure of the pipe of the evaporator becomes relatively high compared with the part where the lower pressure sensor of the main outdoor unit is positioned. In the present invention, whether the pipe is clogged or not is determined by detecting a part where a pressure is increased. Namely, when the pressure of the evaporator is increased as the strainer is clogged, the evaporator cannot be normally operated, so the temperature of the pipe of the evaporator is increased. In this case, in the present invention, the temperature of the pipe of the evaporator is detected and converted into pressure data corresponding to the detected temperature of the pipe, based on which whether the pipe is clogged or not is determined.

Figure 10:
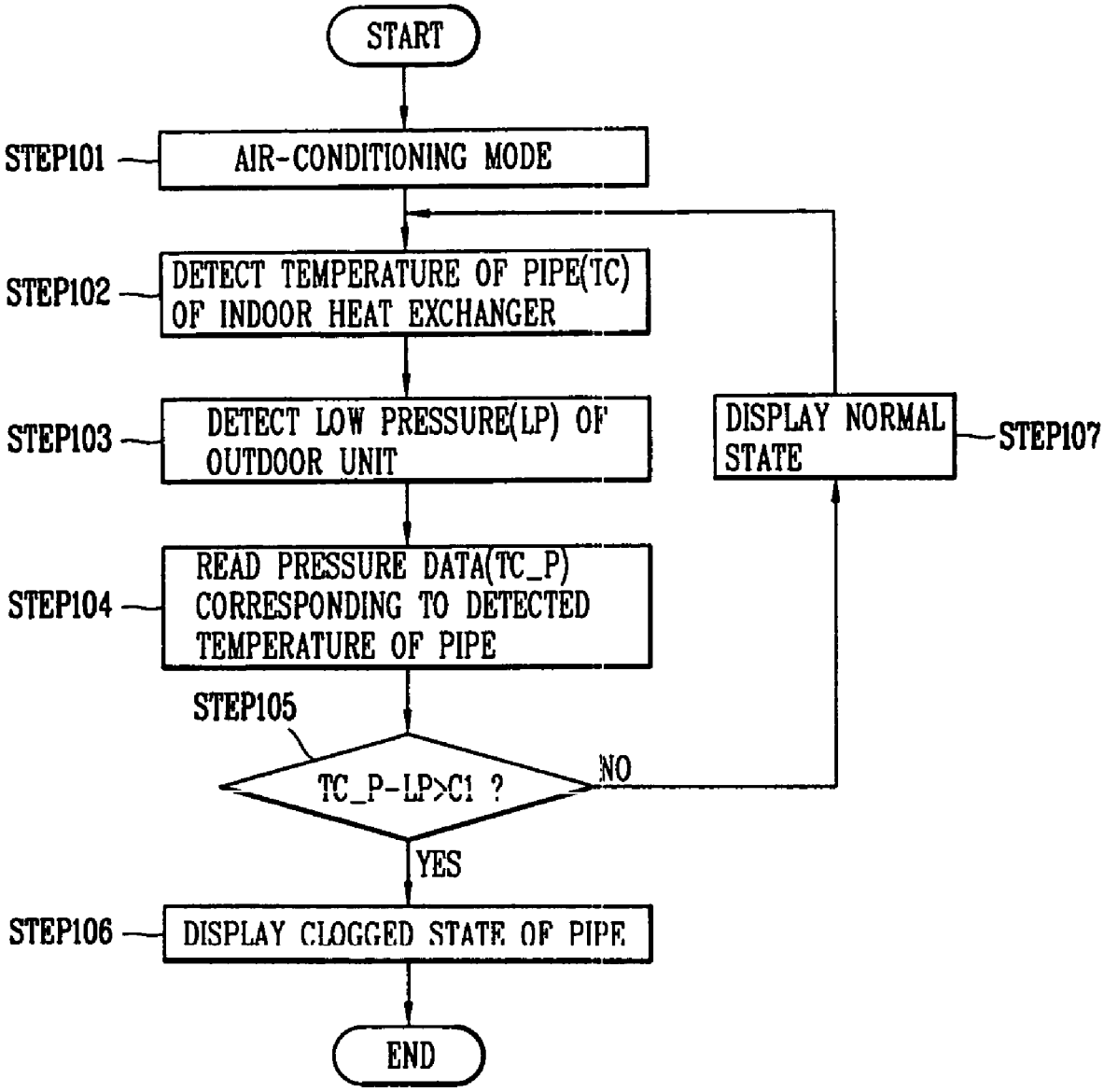
FIG. 10 is a flow chart illustrating processes of a method for detecting a clogged state of a pipe in case of performing the air-conditioning operation of the heat pump type multi-air conditioner in accordance with the present invention.

FIG. 10 is a flow chart illustrating processes of a method for detecting a clogged state of a pipe in case of performing the air-conditioning operation of the heat pump type multi-air conditioner in accordance with the present invention.

First, when the air conditioner is operating in the air-conditioning mode (STEP101), the microcomputer 710 detects a temperature of a pipe (TC) of an arbitrary heat exchanger through the plurality of pipe temperature detection units TC1~TCn (STEP102).

Next, the microcomputer 710 detects a pressure of a refrigerant introduced into an arbitrary outdoor unit through a low pressure sensor of an arbitrary outdoor unit among the plurality of outdoor units OU1~OUm (STEP103).

Subsequently, the microcomputer 710 obtains a pressure (TC_P) corresponding to the detected temperature of the pipe (TC). Namely, the microcomputer 710 reads corresponding pressure data among pressure data previously stored in the storage unit 720 according to the detected temperature of the pipe (TC) and a kind of the refrigerant (STEP104).

And then, the microcomputer 710 compares the pressure (TC_P) according to the detected pipe temperature (TC) and a low pressure detected by a low pressure sensor of an arbitrary outdoor unit among the plurality of outdoor units OU1~OUm, and determines whether the pipe is clogged or not based on the comparison result (STEP105).

If a difference between the pressure (TC_P) according to the pipe terminal and the low pressure measured by the arbitrary outdoor unit is greater than the pre-set first value (C1), the microcomputer 710 recognizes that the pipe is clogged and displays it on the display unit 730 accordingly (STEP105 and STEP106).

If, however, the difference between the pressure (TC_P) according to the pipe terminal and the low pressure measured by the arbitrary outdoor unit is not greater than the pre-set first value (C1), the microcomputer 730 displays that the pipe is in a normal state on the display unit 730, and the process of the air conditioner returns to the STEP102 for detecting a temperature of the pipe of the indoor heat exchanger (STEP105, STEP107).

Figure 11:
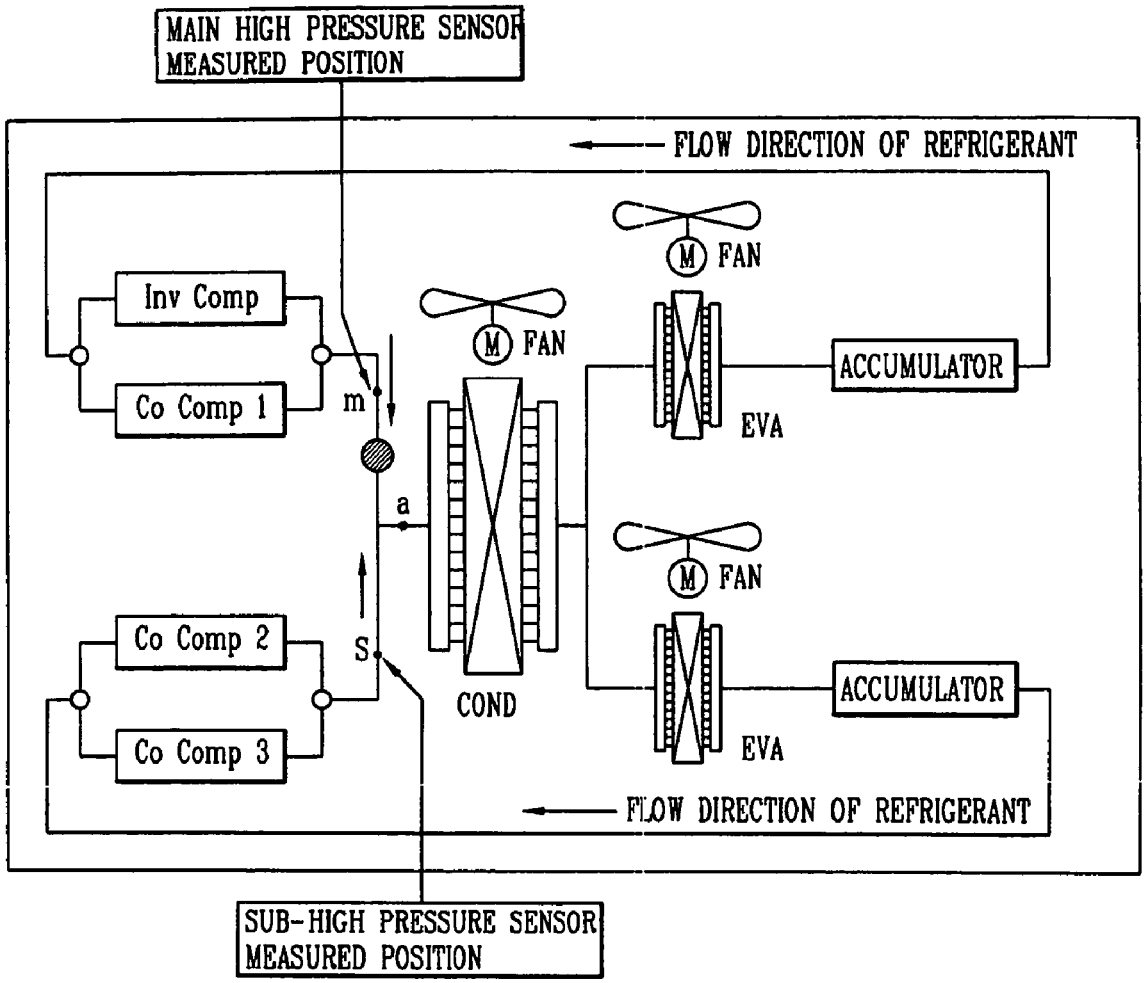
FIG. 11 is a schematic diagram of a refrigerant circulation cycle in case of performing a heating operation of the heat pump type multi-air conditioner including a main outdoor unit and a sub-outdoor unit each having two compressors in accordance with the second embodiment of the present invention.
Figure 12:
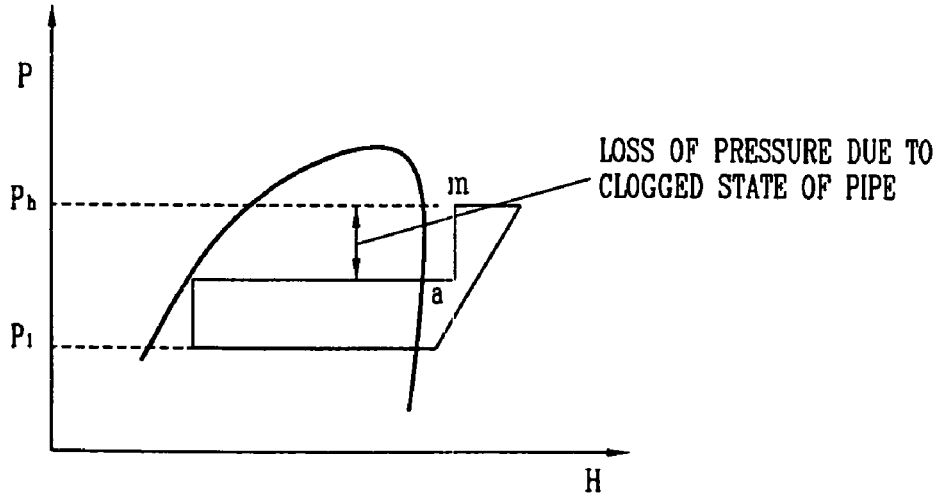
FIG. 12 is a graph showing a P-H diagram showing a state change occurring in the refrigerant circulation cycle when a pipe is clogged in case of performing the heating operation.

FIG. 11 is a schematic diagram of a refrigerant circulation cycle in case of performing a heating operation of the heat pump type multi-air conditioner including a main outdoor unit and a sub-outdoor unit each having two compressors in accordance with the second embodiment of the present invention, and FIG. 12 is a graph showing a P-H diagram showing a state change occurring in the refrigerant circulation cycle when the pipe is clogged in case of performing the heating operation; and As shown in FIG. 11, when the pipe connected from a compressor of the main outdoor unit to the condenser (namely, the indoor heat exchanger) is clogged as debris is collected on the strainer of the pipe, as shown in FIG. 12, a pressure of the pipe of the condenser becomes relatively low compared with the side where a high pressure sensor of the main outdoor unit is positioned. In the present invention, whether the pipe is clogged or not during the heating operation is determined by recognizing the part where the pressure is lowered. In other words, when the pressure of the condenser is lower due to the clogged strainer, the condenser cannot be normally operated so that the temperature of the pipe of the condenser goes down. In the present invention, the temperature of the pipe of the condenser is detected and converted into pressure data corresponding to the detected temperature of the pipe and whether the pipe is clogged or not is determined based on the pressure data.

Figure 13:
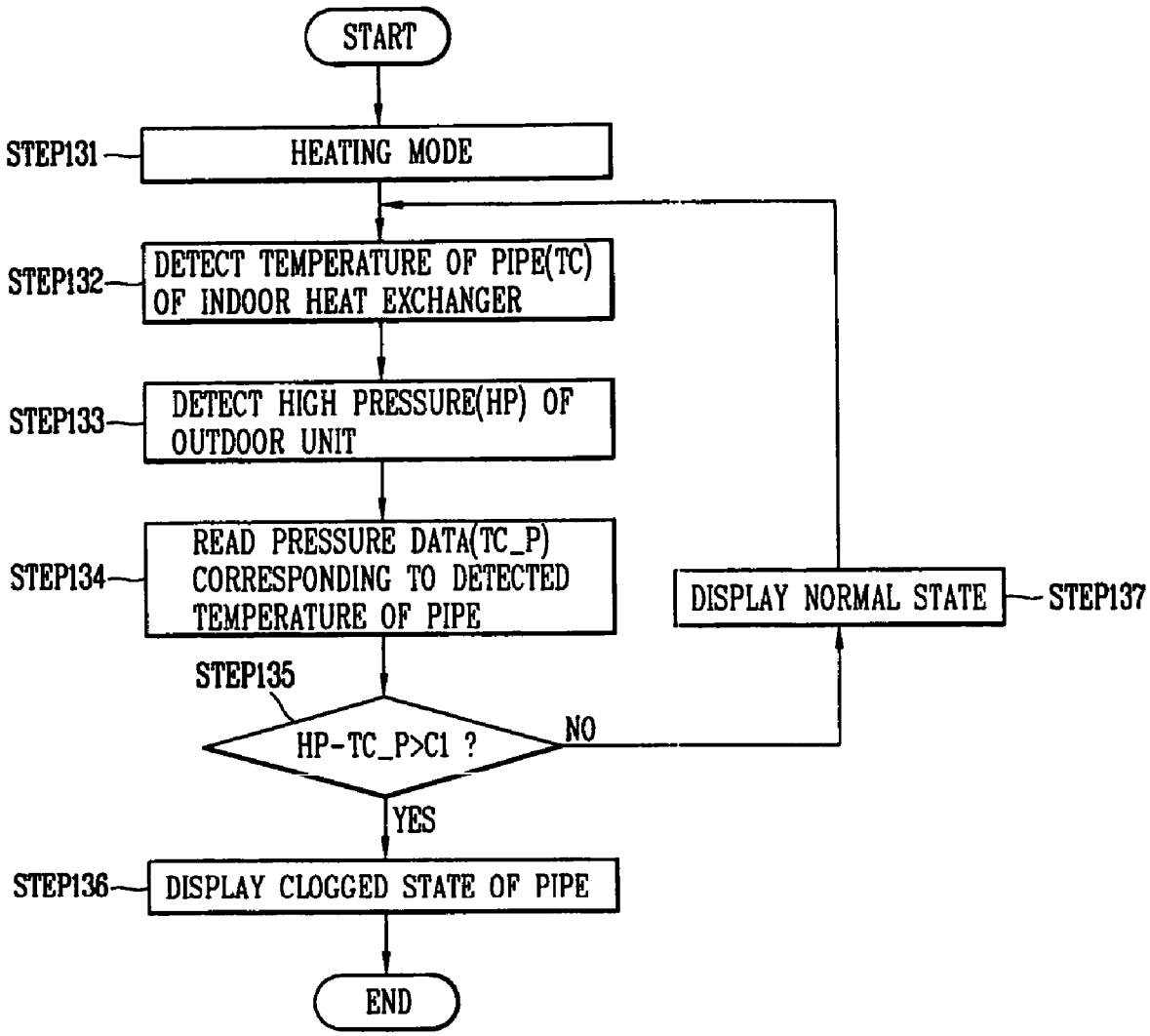
FIG. 13 is a flow chart illustrating processes of a method for detecting a clogged state of a pipe in case of performing the heating operation of the heat pump type multi-air conditioner in accordance with the second embodiment of the present invention.

FIG. 13 is a flow chart illustrating processes of a method for detecting a clogged state of a pipe in case of performing the heating operation of the heat pump type multi-air conditioner in accordance with the second embodiment of the present invention.

When the air conditioner is operating in the heating mode (STEP131), the microcomputer 710 detects a temperature of a pipe of an arbitrary indoor heat exchanger through the plurality of pipe temperature detection units TC1~TCn (STEP132).

Next, the microcomputer 710 detects a pressure of a refrigerant introduced into the indoor heat exchanger after being discharged from a compressor of the arbitrary outdoor unit through a high pressure sensor of the arbitrary outdoor unit among the plurality of outdoor units OU1~OUm (STEP133).

Subsequently, the microcomputer 710 obtains a pressures (TC_P) corresponding to the detected pipe temperature (TC). Namely, the microcomputer 710 reads corresponding pressure data among pressure data previously stored in the storage unit 720 (STEP134).

The microcomputer compares the pressure (TC_P) according to the detected pipe temperature (TC) and a high pressure detected by a high pressure sensor of an arbitrary outdoor unit among the plurality of outdoor units OU1~OUm, and determines whether the pipe is clogged based on the comparison result (STEP135).

If a difference between the pressure (TC_P) according to the pipe terminal and the low pressure measured by the arbitrary outdoor unit is greater than the pre-set second value (C2) the microcomputer 710 recognizes that the pipe is clogged and displays it on the display unit 730 accordingly (STEP135 and STEP136).

If, however, the difference between the pressure (TC_P) according to the pipe terminal and the low pressure measured by the arbitrary outdoor unit is not greater than the pre-set second value (C2), the microcomputer 730 displays that the pipe is in a normal state on the display unit 730, and the process of the air conditioner returns to the STEP132 for detecting a temperature of the pipe of the indoor heat exchanger (STEP135, STEP137).

As so far described, the heat pump type multi-air conditioner having a plurality of outdoor units and a plurality of indoor units have the following advantages.

That is, each refrigerant circulation cycle information according to a normal air-conditioning operation and a normal heating operation is separately set as reference data, and refrigerant circulation cycle information generated while the heat pump type multi-air conditioner is operated in an air-conditioning mode or in a heating mode is compared with the reference data to determine whether a pipe is clogged, thereby preventing a damage of a system due to a clogged state of the pipe.

In addition, a clogged state of a strainer is determined based on a difference between a pressure corresponding to a temperature of a pipe of an indoor heat exchanger and a pressure of a refrigerant sucked into a compressor of an arbitrary outdoor unit among the plurality of outdoor units during the air-conditioning operation, and a clogged state of a pipe based on a difference between a pressure corresponding to a temperature of the pipe of the indoor heat exchanger and a pressure of the refrigerant sucked into the indoor heat exchanger after being discharged from an arbitrary outdoor unit among the plurality of outdoor units, thereby preventing a damage of the system due to the clogged state of the strainer.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A system for detecting a clogged state of a pipe of a heat pump type multi-air conditioner which comprises a plurality of outdoor units and a plurality of indoor units, comprising:

a plurality of first pressure detection sensors for detecting a pressure of a refrigerant sucked into each outdoor unit;

a plurality of second pressure detection sensors for detecting a pressure of a refrigerant discharged from each outdoor unit;

a plurality of pipe temperature detection units for detecting a temperature of each pipe of a plurality of indoor heat exchangers;

a storage unit for storing first pressure data corresponding to each temperature of each pipe of each indoor heat exchanger detected by the plurality of pipe temperature detection units when performing an air-conditioning operation and second pressure data corresponding to each temperature of each pipe of each indoor heat exchanger detected by the plurality of pipe temperature detection units when performing a heating operation; and a microcomputer for comparing low pressure data detected by an arbitrary first pressure detection sensor among the plurality of first pressure detection sensors with the first pressure data and recognizing that a pipe of an outdoor unit having the arbitrary first pressure detection sensor is clogged if a difference value between the low pressure data and the first pressure data is greater than a first pre-set value, while the pipe is recognized to be in a normal state when the difference value is not greater than the first pre-set value when performing the air-conditioning operation, and comparing high pressure data detected by an arbitrary second pressure detection sensor among the plurality of second pressure detection sensors with the second pressure data and recognizing that a pipe of an outdoor unit having the arbitrary second pressure detection sensor is clogged if a difference value between the high pressure data and the second pressure data is greater than a second pre-set value, while the pipe is recognized to be in the normal state when the difference value is not greater than the first pre-set value when performing the heating operation.

2. The system of claim 1, further comprising:

a display unit for displaying the determining result.

3. A system for detecting a clogged state of a pipe of a heat pump type multi-air conditioner which comprises a plurality of outdoor units and a plurality of indoor units, comprising:

a storage unit for storing data of a first curved line pattern obtained by converting a curved line pattern according to a high pressure and a low pressure of a refrigerant circulation cycle and an operation frequency of a compressor into a curved line pattern according to an indoor temperature, an outdoor temperature and capacity of an indoor unit, in case of a normal operation;

a plurality of indoor temperature sensors for detecting indoor temperatures of an area where a plurality of indoor units are positioned;

a plurality of outdoor temperature sensors for detecting outdoor temperatures of an area where a plurality of outdoor units are positioned; and a microcomputer for selecting an arbitrary indoor unit among the plurality of indoor units and an arbitrary outdoor unit among the plurality of outdoor units, generating a second curved line pattern based on an indoor temperature detected by an indoor temperature sensor of the arbitrary indoor unit, an outdoor temperature detected by an outdoor temperature sensor of the arbitrary outdoor unit, and an operation capacity of a compressor of the arbitrary outdoor unit, comparing the second curved line pattern with the first curved line pattern, and recognizing that a pipe of the arbitrary outdoor unit is clogged when a difference between the first curved line pattern and the second curved line pattern is greater than a pre-set value, while the pipe is recognized to be in a normal state when the difference is not greater than the pre-set value.

4. The system of claim 3, further comprising:

a display unit for display the determining result.

5. A method for detecting a clogged state of a pipe of a heat pump type multi-air conditioner which comprises a plurality of outdoor units and a plurality of indoor units, comprising:

detecting a temperature of a pipe of an arbitrary indoor heat exchanger among a plurality of indoor heat exchangers;

detecting a pressure of a refrigerant sucked into an arbitrary outdoor unit among the plurality of outdoor units in case of performing an air-conditioning operation, and detecting a pressure of a refrigerant introduced into the arbitrary indoor heat exchanger after being discharged from an arbitrary outdoor unit among the plurality of outdoor units in case of performing a heating operation;

comparing a pressure corresponding to the detected temperature of the pipe and the detected pressure of the refrigerant; and determining whether the pipe is clogged based on the comparison result, wherein, in the step of determining whether the pipe is clogged, the pipe is recognized to be clogged when a difference between the pressure corresponding to the temperature of the pipe and the detected pressure of the refrigerant is greater than a pre-set value, while the pipe is recognized to be in a normal state when the difference is not greater than the pre-set value.

6. The method of claim 5, further comprising:

displaying the determination result on the display unit when the pipe is determined to be in a clogged state, and returning to the step of detecting a temperature of a pipe of an arbitrary indoor heat exchanger among the plurality of indoor heat exchangers when the pipe is determined to be in a normal state.

7. The method of claim 5, wherein the pressure corresponding to the detected temperature of the pipe is pressure data corresponding to the detected temperature of the pipe among pressure data previously stored in a storage unit.

8. The method of claim 7, wherein the pressure data previously stored in the storage unit has a different value according to a type of the refrigerant and a temperature of the pipe of the indoor heat exchanger.

9. A method for detecting a clogged state of a heat pump type multi-air conditioner which comprises a plurality of outdoor units and a plurality of indoor units comprising:

operating in an air-conditioning mode;

detecting a temperature of a pipe of an arbitrary indoor heat exchanger among a plurality of indoor heat exchangers;

detecting a pressure of a refrigerant sucked into an arbitrary outdoor unit among a plurality of outdoor units;

obtaining a pressure corresponding to the detected temperature of the pipe;

comparing a pressure corresponding to the detected temperature of the pipe and a pressure of the detected refrigerant; and determining whether the pipe is clogged based on the comparison result when a difference between the pressure corresponding to the temperature of the pipe and the detected pressure of the refrigerant is greater than a pre-set value, while the pipe is recognized to be in a normal state when the difference is not greater than the pre-set value.

10. The method of claim 9, further comprising:

displaying the determination result on the display unit when the pipe is determined to be in a clogged state, and returning to the step of detecting a temperature of a pipe of an arbitrary indoor heat exchanger among the plurality of indoor heat exchangers when the pipe is determined to be in a normal state.

11. The method of claim 9, wherein the pressure corresponding to the detected temperature of the pipe is pressure data corresponding to the detected temperature of the pipe among pressure data previously stored in a storage unit.

12. The method of claim 11, wherein the pressure data previously stored in the storage unit has a different value according to a type of the refrigerant and a temperature of the pipe of the indoor heat exchanger.

13. A method for detecting a clogged state of a heat pump type multi-air conditioner which comprises a plurality of outdoor units and a plurality of indoor units comprising:

operating in a heating mode;

detecting a temperature of a pipe of an arbitrary indoor heat exchanger among a plurality of indoor heat exchangers;

obtaining a pressure corresponding to the detected temperature of the pipe;

detecting a pressure of a refrigerant introduced into the arbitrary indoor heat exchanger after being discharged from an arbitrary outdoor unit among a plurality of outdoor units;

comparing a pressure corresponding to the detected temperature of the pipe and a pressure of the detected refrigerant; and determining whether the pipe is clogged based on the comparison result when a difference between the pressure corresponding to the temperature of the pipe and the detected pressure of the refrigerant is greater than a pre-set value, while the pipe is recognized to be in a normal state when the difference is not greater than the pre-set value.

14. The method of claim 13, further comprising:

displaying the determination result on the display unit when the pipe is determined to be in a clogged state, and returning to the step of detecting a temperature of a pipe of an arbitrary indoor heat exchanger among the plurality of indoor heat exchangers when the pipe is determined to be in a normal state.

15. The method of claim 13, wherein the pressure corresponding to the detected temperature of the pipe is pressure data corresponding to the detected temperature of the pipe among pressure data previously stored in a storage unit.

16. The method of claim 15, wherein the pressure data previously stored in the storage unit has a different value according to a type of the refrigerant and a temperature of the pipe of the indoor heat exchanger.

* * * * *